United States Patent [19]

Kortenhaus

[11] 3,982,620

[45] Sept. 28, 1976

[54] COIN COMPUTING APPARATUS

[75] Inventor: Dieter Kortenhaus, Bingen, Germany

[73] Assignee: NSM Apparatebau GmbH Kommanditgesellschaft, Bingen, Germany

[22] Filed: Sept. 9, 1974

[21] Appl. No.: 504,128

Related U.S. Application Data

[63] Continuation-in-part of Ser. No. 325,675, Jan. 22, 1973.

[30] Foreign Application Priority Data

Jan. 25, 1972 Germany ..... 2203392

[52] U.S. Cl. ..... 194/1 N; 194/15

[51] Int. Cl.[2] ..... G07F 9/08

[58] Field of Search ..... 194/1 N, DIG. 3, 9, 194/10, 13, 15; 235/92 CN, 92 SH, 92 DP; 340/172.5; 445/1

[56] References Cited

UNITED STATES PATENTS

| | | | |
|---|---|---|---|
| 3,321,747 | 5/1967 | Adamson | 340/172.5 |
| 3,500,339 | 3/1970 | White | 235/92 SH |
| 3,511,351 | 5/1970 | Jones | 194/15 |
| 3,594,732 | 7/1971 | Mendelson et al. | 340/172.5 |
| 3,741,246 | 6/1973 | Braytenbah | 340/172.5 X |
| 3,801,963 | 4/1974 | Chen | 340/172.5 |
| 3,807,541 | 4/1974 | Kortenhaus | 194/1 N |

OTHER PUBLICATIONS

IBM Technical Disclosure Bulletin, "Instruction Retry Mechanism for a Computer," vol. 17, No. 8, pp. 1–75.

*Primary Examiner*—Stanley H. Tollberg
*Assistant Examiner*—Joseph J. Rolla
*Attorney, Agent, or Firm*—W. G. Fasse; W. W. Roberts

[57] ABSTRACT

A coin computing apparatus includes an input for converting coin values received to coin unit data for storage along with other data. This data is subsequently converted to unit data for controlling operation of the device or the dispensing of articles. The storage includes a temporary storage for storing play unit data as it is received and a permanent storage device for receiving data from the temporary storage device for updating purposes. A read/write control device is included for reading the permanent storage data to the temporary storage means following interruptions such as power failures.

11 Claims, 2 Drawing Figures

COIN COMPUTING APPARATUS

This application is a continuation-in-part application of copending applicaton Ser. No. 325,675 filed Jan. 22, 1973.

BACKGROUND OF THE INVENTION

This invention relates to coin computing systems, and is especially adapted for use in devices of the type providing signals corresponding to outputs, in the form of articles of monetary value or play units.

Coin computers of known construction generally employ mechanical opoerating means. Such devices have relatively low operating convenience, for example, with respect to the speed of operation required for computing the coins and permitting the operation of the devices. In addition, mechanical operating means are subject to frequent breakdowns due to wear, and thus, in addition to discouraging operation, result in the necessity to remove the machines from operation for periods of time. In addition, coin computers of this type, whether they are incorporated in automatic dispensing devices, jukeboxes or coin change machines, are adapted only to accept coins in succession, thereby requiring an operator to wait after the insertion of each coin until the machine has registered, before inserting the next coin.

OBJECTS OF THE INVENTION

In view of the above, it is an object of this invention to provide a coin computer apparatus that overcomes the above problems of mechanical devices.

It is a further object of the invention to provide a coin computer that is characterized by rapid operation, lack of susceptibility to breakdown due to wear, and that it is adapted to accept coins of different denominations simultaneously.

A still further object of the invention is to provide a coin computer in the form of electrical components, and including means for preventing loss of information resulting from electrical failure or other interfering conditions, and that additionally is simple in construction and is substantially independent of operational failures.

SUMMARY OF THE INVENTION

Briefly stated, in accordance with the invention, the above objects are achieved by providing a coin computer having a coin receiver adapted to simultaneously accept coins of different denominations. Means are provided for filtering and evaluating data corresponding to the coins accepted, and for adding the thus evaluated units. In the evaluation of the coins, the apparatus converts the coin value to coin unit data. Means are also provided for the conversion of coin unit data into output unit data. An information storage and coordinated indicator unit are provided, including means for the conversion of coin unit data into coin value data for display.

The apparatus according to the invention further comprises a coin counter for the summation of coin units corresponding to coins accepted by the device. The counter is connected to a data storage unit, which may be in the form of a plug-in module. The data storage unit has several additional storage devices, one of which may be a cash register for indicating the value of cash in the device. The cash register may have a mechanical read-out so that it is not necessary to count the cash contents of the device directly at the location of the machine. The cash register information may be available, for example, on a digital glow read-out at a remote location. Total accounting for several machines may therefore be mechanized, since the data storage unit may be connected with a processing unit, and can automatically provide inputs relating to the arbitrary code number of the machine and the amount of cash received by the machine. This arrangement is very tamper-proof, since the information data can be stored in a core storage unit in coded form. The total counter data in the machine may also be transferred to a print-out register, for simultaneously adding up the sum total when the cash contents of the device are emptied by an owner. This may be accomplished by interconnecting the coin computer, for example, with a small printing disk computer.

In devices of the above type, outputs are provided corresponding to various forms of operation in the machine. In addition, means are provided for controlling the dispensing of articles in the machine, the value of dispensed articles being subtracted from the coin counter.

The device according to the invention has a small size since it can be compactly constructed, for example, using integrated circuitry. The device accordingly has small production costs, and is easily adapted to changes of the input variables from the device. In addition, the computer may also readily be adaptable to other coin computing operations within the teaching of the invention. Furthermore, a coin computer of the type of the invention is independent of malfunctioning and is not subject to loss of information due to electrical failure, and it is always ready for reception of coins from a user.

BRIEF FIGURE DESCRIPTION

In order that the invention will be more clearly understood, it will now be described, by way of example, with reference to the accompanying drawings, in which:

FIG. 1 is a block diagram of a coin computer in combination with various elements of a device, in accordance with the invention; and FIG. 2 is a block diagram illustrating certain elements of the arrangement of FIG. 1 in greater detail.

DETAILED DESCRIPTION OF EXAMPLE EMBODIMENTS

Figure 1:
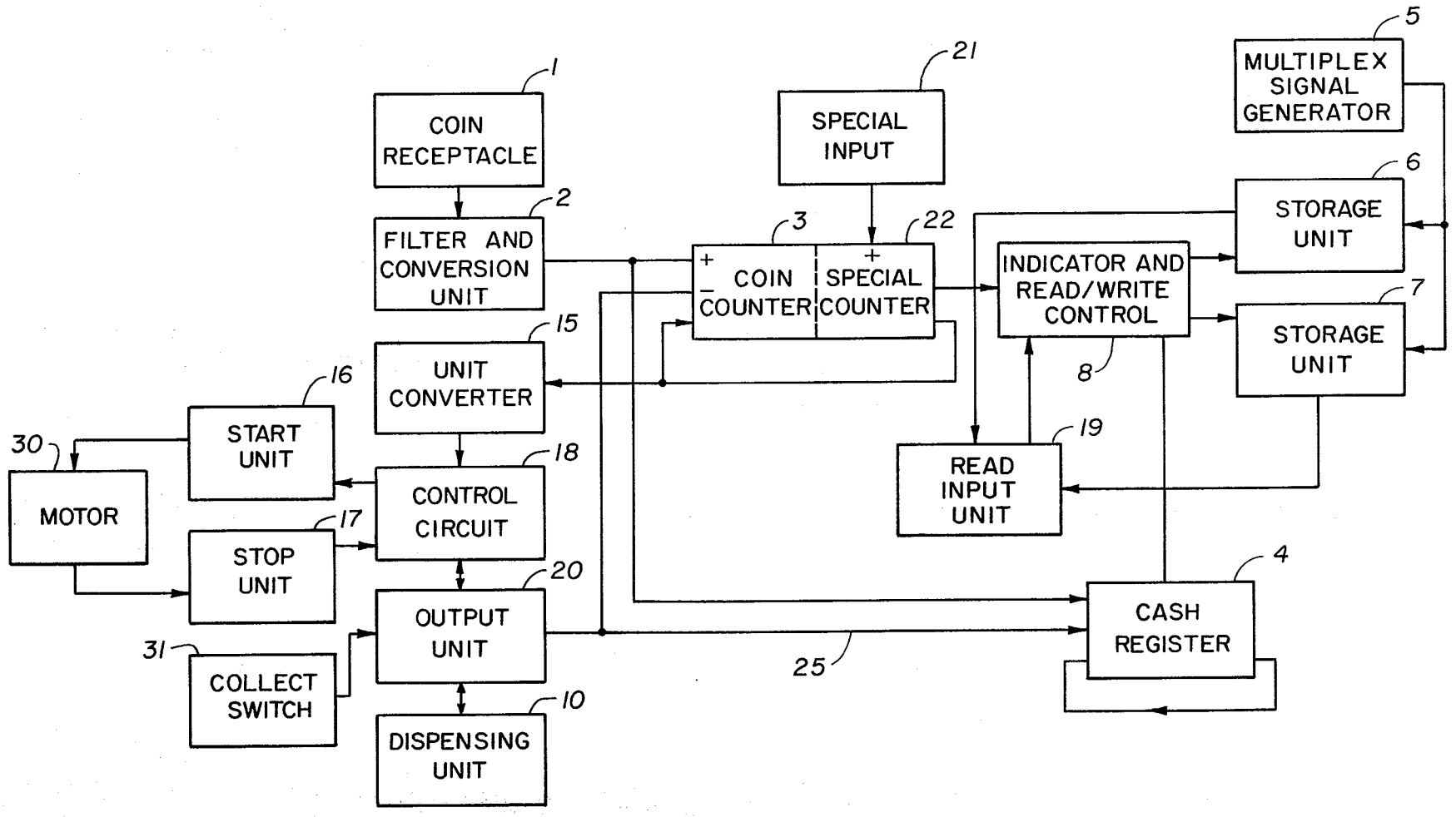

Referring now to the drawings, and more in particular to FIG. 1, wherein is illustrated a coin computer device in accordance with the invention. In this arrangement, a coin receptacle device 1 is provided for receiving coins from a user for operation of the device. The coin receptacle may be of a conventional nature, and is adpated to simultaneously accept coins of the different denominations currently in use. This unit provides output signals to the filter and conversion unit 2, the output signals corresponding to the number and type of coins deposited in the receptacle 1. The receptacle 1 is preferably multiplexed to the unit 2, for example, so that the signals distinguish the different denominations of coins inserted in the receptacle. The filter and conversion unit 2 includes conventional filter circuits for filtering the input signals to remove interference and to overcome the effects of contact impact induced pulses from the receptacle 1. The unit 2 also includes means for multiplying the coin value signals from the receptacle 1 into coin unit signals, for example, by multiplying the coin value signals corresponding to different denominations by different factors. For example, if a coin unit in the device is the equivalent of five cents, coin value signals corresponding to a single five cent piece would be multiplied by a unity factor, coin value signals corresponding to dimes would be multiplied by a factor of two, coin value signals corresponding to quarters would be multiplied by a factor of five, etc. The filter and conversion unit may thus also employ conventional circuitry for the filtering and multiplication of input signals.

The coin unit signals from the unit 2 are supplied to the coin counter 3 and also are written into a cash register unit 4. The coin counter 3 may be a dynamic shift register having a capacity for storing signals, and the cash register 4 may also be a shift register having the capacity for storing signals. The coin counter 3 and cash register 4 therefore store information in the form of coin units.

The machine may also be provided with a special input device 21. As an example, in a jukebox it may be desirable to provide means enabling the playing of records without the insertion of coins in the device. This device, which is also a part of the machine itself and not an integral part of the coin computer according to the invention, may be arranged to provide "special" operation in accordance with any desired technique. The special inputs, which correspond to operation units and hence not cash value, are applied to a special counter 22, which may be connected to the coin counter 3 so that the units 3 and 22 form a single registry unit. As an example, the combined registers 3 and 22 may be in a form of a 28-bit register for storing seven BCD groups corresponding to seven decimal digits, with four of the digits forming the coin counter and three of the digits forming the special couner. When the operator plays "special" plays, one play unit is subtracted from the special counter 22 at each special play, the subtraction being accomplished in conventional nature in unit 22. In a preferred arrangement, the special play counter 22 in the form of a storage unit which, in the event of a given occurrence, replaces its previously stored data with new data derived from the machine. Alternatively, however, the special counter may also be connected to be switched by external means in the device so that previously stored data is compared with new data derived in the device, so that the desired information is maintained in storage in this unit.

As will be apparent from the following paragraph, if the combined units 3 and 22 form a 28-bit register, it is also advantageous for the cash register 4 to be in the form of a 28-bit register.

Figure 2:
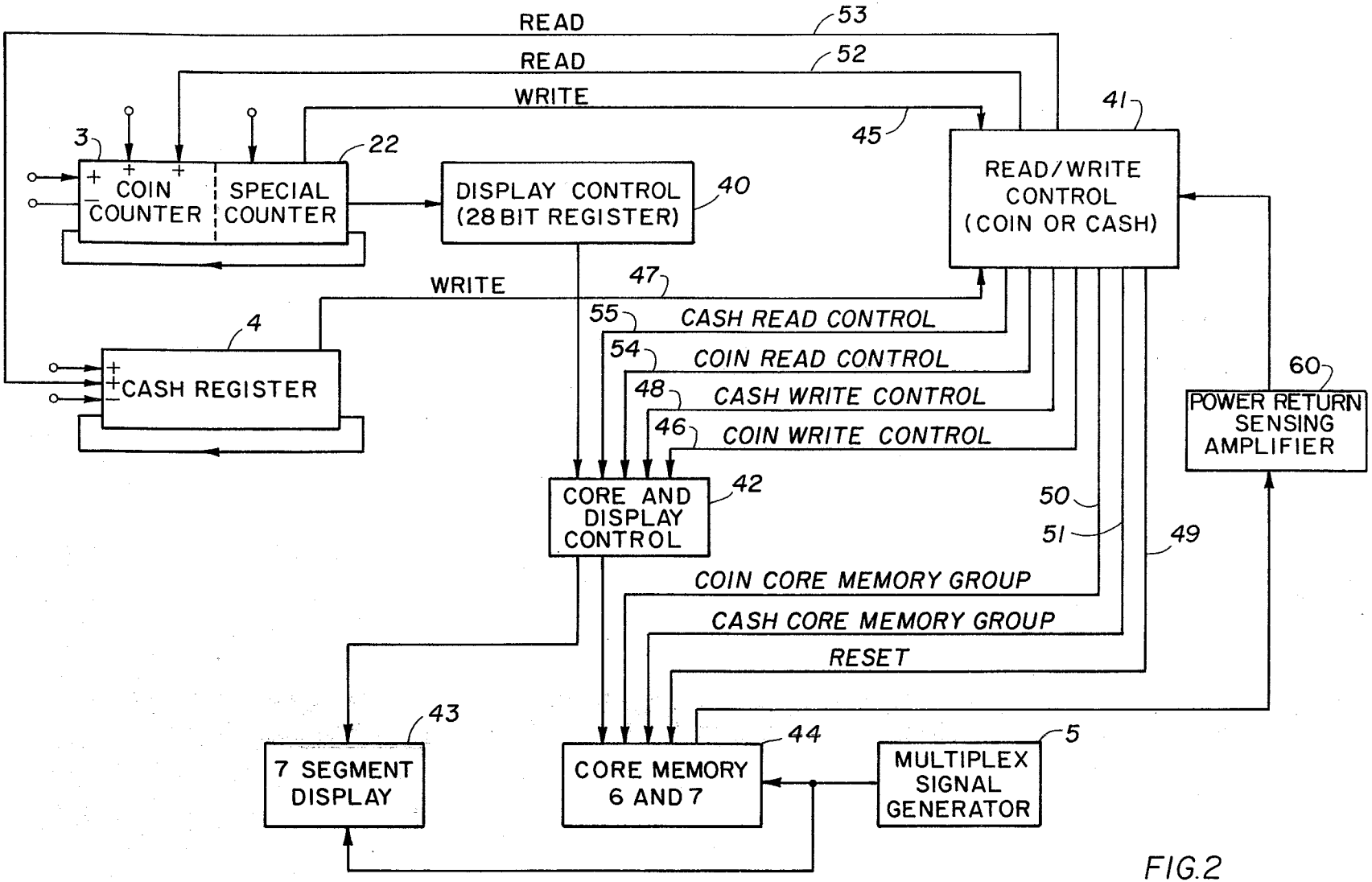

The arrangement of FIG. 1 is also provided with permanent storage units 6 and 7, such as core storage units, a multiplex signal generator 5, and indicator and read/write control device 8, as well as a read input unit 19. These units, which will be described in greater detail with reference to FIG. 2, operate in the following manner: when an input is provided to either the counter 3 or the register 4, the contents of the counter 3 and register 4 are automatically written in the storage units 6 and 7 respectively, under control of the control 8, with information previously stored in the units 6 and/or 7 being cleared so that the data is stored in the units 6 and 7 is continually being updated as data is stored in the counter 3 and register 4. The control unit 8 also includes an indicator for continually indicating the data stored in the counters 3 and 22. As will be described in greater detail in the following paragraph, the writing of data in the units 6 and 7 is under control of signals from a multiplex signal generator 5. In the event of a power failure or other event which may disturb the storage in the counters 3 and 22 and in the register 4, information will still be retained in the permanent storage units 6 and 7. Restoration of power to the units or the removal of any other disturbing condition is sensed by an amplifier 60 in the read input unit 19, so that the data stored in the permanent storage units 6 and 7 will be read, that is re-transferred or returned into the counters 3 and 22 and register 4. For this purpose the core memory 44, which includes the storage units 6 and 7 as shown in FIG. 2, is connected through the sense amplifier 60 to the read/write control 41, which is part of block 8 in FIG. 1, and which in turn is connected through conductors 52, 53 to the counters 3 and 22 and to the cash register 4. The reading-out of the units 6 and 7 results in the clearing or erasing of data stored therein, and in the re-storing of this data in the counters 3 and 22 and in the register 4. However, any storing of data in 3, 22 and 4 automatically results in the storing of the same data in the units 6 and 7 through the control unit 8. Logic circuit means for responding to a power failure and also for responding to the return of power are described in U.S. Pat. No. 3,321,747, granted May 23, 1967.

As above discussed, the data stored in the coin counter 3 is in the form of coin units, the base for the coin unit amount being arbitrarily selected, if desired, are the basis of the lowest value of coin which may be inserted in the device. The operation of the device may, however, correspond to a multiple of the coin unit base and therefore to effect the operation of the device it is necessary to provide a conversion between the data stored in the counter 3 and the mechanism which will be employed to effect the starting of an operation of the machine. The conversion, which may, for example, be in the form of a multiplication of the coin units by a factor of zero to seven, is acccomplished in a unit converter 15 connected to the coin unit data stored in coin counter 3. The output of the convertor 15 is a signal corresponding to the occurrence of adequate coin units stored in the counter 3 for operation of the device. The convertor 15 may thus be a conventional multiplier circuit.

In a device of one type under consideration herein, e.g. in a jukebox, a "play" operation may be an event that requires a given time for completion. As an example, the play may be controlled by means of a conventional motor 30. In order to start the motor 30 for commencing a play in the unit, a signal from the convertor 15 indicating sufficient coin units in the counter 3 for the play is applied to a start unit 16 by way of a control circuit 18. The start unit 16 may therefore be any suitable circuit for effecting the initiation of operation of the motor 30, with the control circuit 18 providing the control for operation of the unit 16 in response to the receipts of a unit signal from the convertor 15. Upon completion of the play, the motor 30 signals a stop unit 17 in a conventional manner, and the stop unit 17 provides a signal to the control circuit 18 indicating that the play has been completed. The motor 30 may thus be operated continually as long as the signal outputs of the convertor 15 indicates that play units are available for playing. The stop unit 17 also resets the start unit 16 back to its zero position after the finish of a given play, so that a new play may be started if there are sufficient play units available. As an example, the stop unit 17 may be a contact controlled directly or indirectly by the motor which is open during the play and closed to stop the play. This far, it will be apparent that the control circuit 18 may be in the form of a conventional circuit which applies a starting signal to the unit 16 in response to the receipt of a play signal from the convertor 15, which receives a stop signal from the unit 17 at the end of a play, and which in response thereto resets the start unit 16 so that a new play may begin if adequate input signals are available.

In addition, the control circuit 18 may include conventional circuits for insuring that a play cannot be started in the event of a disturbance in the machine, such as the loss of power to the coin computer.

The device may also include a dispensing unit 10. The dispensing unit 10 is operated under the control of the output unit 20, which is in turn responsive to the output of the control circuit 18. The operation of the control unit 20 to cause the control of the dispensing unit 10 is effected by operation of a collect switch 31 which the user opoerates when he desires to receive an output having monetary value. The value of articles which may be dispensed is determined by the coin units that are stored in the counter 3, which is applied to the output unit 20 by way of the convertor 15 and control circuit 18, the control circuit 18 preventing operation of the dispensing unit during operation of a play as above stated. The value of articles dispensed is subtracted from the data stored in the coin counter 3, and cash register 4, under control of the output unit 20 as illustrated in FIG. 1. The circuits of the output unit 20 may thus comprise conventional comparing circuits, and including control means for releasing the articles from the dispensing unit 10.

When the apparatus is employed as a jukebox, the dispensing unit 10 and collect switch 31 may be omitted, although these units may be provided if it is desired to provide means enabling the user to receive coins instead of continuing to play records in return for deposited money. In this case, the dispensing unit 10 provides means for changing money for the user, if he does not have coins of the correct monetary value for the number of records he wishes to hear. Alternatively, the apparatus may be employed solely for dispensing purposes, in which case the device 30 is omitted, the start switch then serving to intially control the control circuit 18 to thereby control the output unit 20 in the dispensing of articles by the dispensing unit 10. In the latter case the dispensing unit may be adapted to dispense coins, as in a coin changing apparatus. The dispensing unit may be of conventional construction. It is further noted that the computing apparatus in accordance with the invention may be employed in combination with a gambling machine.

Referring now to FIG. 2, therein is illustrated in more detail the portion of the circuit of FIG. 1 including multiplex signal generator 5, storage units 6 and 7, control unit 8 and read input 19. This circuit includes a display control unit 40 which includes a 28-bit register, a read/write control unit 41, a core and display control unit 42 and a seven segment display 43. These elements form the control unit 8 of FIG. 1.

In the arrangement of FIG. 2, the storage units 6 and 7 are combined in a core memory 44 which enables the storing of coin and cash data in a single unit. For this purpose, the core memory 44 may comprise a core memory having eight rows and seven columns, with four of the rows corresponding to coin memory and four of the rows corresponding to cash memory. The multiplex signal generator 5 is provided for multiplexing the core memory, for example, for sequentially applying pulses to the seven columns of the core memory. For this purpose, the interconnection between the signal generator 5 and the core memory 44 may be comprised of seven leads.

An output of the coin counter 3 and special counter 22 register is applied by way of write lead 45 to the read/write control circuit 41, so that when data is written into the units 3 and 22, this data is also written in the four rows of the core memory 44 through the coin write control lines 46, and through the core and display control 42, under the control of the multiplexing pulses from the signal generator 5. In a similar manner, the output of the cash register 4 is applied through the write lines 47 to the control unit 41 for writing in the cash rows of the core memory 44 through the cash write lines 48 and the control unit 42. Thus, whenever data is written in the units 3/22 and 4, this data is stored in the core memory 44 in the corresponding rows under the control of the multiplex signal generator 5. The output of the control unit 42 is a BCD signal. The operation of writing data in the core memory 44 effects the erasing of data previously stored therein by means of the reset line 49 from the control unit 41. The coin and cash rows of the core memory are selected by means of the coin core memory group line 50 and the cash core memory group line 51 from the control unit 41, which control the corresponding rows of the core memory. In the event of a power failure, as above stated, the data stored in the counter 3/22 and register 4 will be lost, but this data is still stored in the core memory 44. Upon resumption of the power, the core memory 44 is read out under control of the power return sensing amplifier 60 which forms a part of the read input unit 19 of FIG. 1, and the signal generator 5 so that the data corresponding to the coin and cash rows of the core memory 44 are returned into the counter 3/22 and into the register 4 respectively through the control unit 41 and through the read lines 52 and 53 respectively.

The data is also restored in the core memory 44 by way of control lines 54 and 55 and the control unit 42. The section of the core memory 44 being read out is controlled by signals on the lines 50 and 51 under the control of unit 51. The display control unit 40 contains a 28-bit register receiving a serial output of the counter 3/22, and this register acts as a series to parallel convertor. The last four outputs of the 28-bit shift register are applied to the control unit 42, and the BCD output of this control unit is supplied to a conventional seven segment display 43 for providing the display of the contents of the counter 3/22 under the control of the multiplex signal pulses from the generator 5. The multiplex signals thus may provide the anode signals for the display unit 43.

In the arrangement of FIG. 2, it is thus apparent that the read function is only active following a power failure or other distrubance and this function only serves to store the data in the counter 3/22 and the register 4 that had been permanently stored in the core memory 44. In the write function, however, data entered into the counter 3/22 and register 4 is continually updating the information stored in the core memory 44. The seven segment display 43 displays the data of the counter 3/22 in the form of coin values, since this is the information that a player desires to see. Since the counter 3/22 stores information in the form of coin units, the necessary conversion to coin values may be effected, for example, by conventional multiplication in the control unit 42.

The storage units 6 and 7, which are coordinated with the counter 3/22 and the indicator and read/write control unit 8 may advantageously be in the form of plugged-in modules. It is particurly advantageous for the units of the coin computer according to the invention to be in the form of integrated circuits.

The control unit 42 serves to convert the serial signals received thereby to BCD signals for the use of the core memory, and conventional circuits may be employed for this purpose. As noted above, this unit may also provide the necessary multiplication factor for the signals applied to the display 43. Since the display control 40 is employed for the purpose of controlling the seven segment display 43, independently of the writing operation in the core memory, the signals for operating the display 43 are not under control of the control unit 41. The control unit 41 employs conventional circuitry to receive the serial signals from the various inputs and to provide control signals, for example, on the lines 50 and 51, in response to the receipt of the various signals for controlling the storage in the proper portion of the core memory 44. For example, upon receipt of a write signal on the line 45, the data from this line is supplied to the coin write control line 46 to effect storage of the signal in the core memory 44 and the receipt of this signal also provides a control signal on the line 50 for opening the respective portion of the core memory 44.

Although the invention has been described with reference to specific example embodiments, it is to be understood, that it is intended to cover all modifications and equivalents within the scope of the appended claims.

What is claimed is:

1. An apparatus for computing coin related data comprising means for receiving coins, shift register means to act as temporary storing means, means responsive to the receipt of coins for producing and storing data corresponding to coin units in said temporary storing shift register means, magnetic core storage means to act as permanent storing means, and control means for continually updating data stored in said permanent storing magnetic core storage means from said temporary storing shift register means, said control means comprising means for reading data from said permanent storing magnetic core storage means and writing it in said temporary storing shift register means in response to cessation of a condition interfering with storage in said temporary storing shift register means, said reading means comprising means for subsequently storing the read-out data again in said permanent storing means, said control means further comprising means for erasing data stored in said permanent storing magnetic core storage means in response to the reading thereof by said reading means and also simultaneously with the updating of data therein by said means for updating data.

2. The apparatus of claim 1, further comprising display means operatively connected to said temporary storing shift register means for indicating the value of coins corresponding to coin unit data stored in said temporary storing shift register means.

3. The apparatus of claim 1, further including means for producing additional coin unit data signals, said apparatus further comprising a special counter, and means for applying said additonal coin unit data signals to said special counter, said temporary storing shift register means and special counter being comprised of a shift register having a first portion corresponding to coin unit data corresponding to received coins, and a second portion corresponding to said additional coin unit data signals, and further comprising means for indicating the data stored in said first and second portions of said temporary storing shift register means.

4. The apparatus of claim 1, wherein said temporary storing means comprises first and second shift registers, said means responsive to the receipt of coins comprising means for applying said coin unit data to said first and second shift registers, said permanent storing means comprising first and second core storage units, said means for updating data comprising means responsive to the writing of data in said first and second registers for erasing data previously stored in said core storage units and writing therein data from said first and second shift registers respectively, and means responsive to the cessation of a condition interfering with storage in said shift registers for reading out data stored in said first and second core storage units to said first and second registers respectively, and subsequently to restoring said read out data in the respective core storage units.

5. The apparatus of claim 4 for use in a device of the type further including means for producing additional coin unit data signals, said first shift register having first and second portions, said means for storing coin unit data comprising means for applying the coin unit data corresponding to received coins to said first portion and further comprising means for applying said additional coin unit data signals to said second portion.

6. The apparatus of claim 4, further comprising multiplex signal generator means for controlling the writing-in and reading-out of data from said core storage units.

7. The apparatus of claim 1 for use in a machine of the type having means for controlling the operation of the machine and dispensing means, said means for receiving coins comprising means for receiving coins of different denominations, and means for providing coin unit data corresponding to the coins received, means connected to said temporary storing shift register means for converting coin unit data to operation unit data, means responsive to said operation unit data for initiating operation of said operation controlling means, said controlling means being connected to control the operation of said dispensing meaans, and means responsive to operation of said dispensing means for subtracting corresponding data from said temporary storing shift register means.

8. The apparatus of claim 7, wherein said means for providing coin unit data comprises filtering means for filtering interfering signals.

9. The apparatus of claim 7, wherein said means for converting coin unit data to operation unit data comprises multiplying means for multiplying coin unit data by a multiplication factor from zero to seven.

10. The apparatus of claim 7, further comprising a source of value related signals, a second temporary storing shift register means connected to receive said value related signals, means for writing data from said second temporary storing shift register means in said permanent storing mangetic core storage means, and means for reading data from said permanent storing magnetic core storage means corresponding to data received from said second storing means into said second temporary storing shift register means in response to cessation of said interfering condition.

11. The apparatus of claim 10, wherein said subtracting means comprises means for subtracting data from the first mentioned and second temporary storing shift register means.

* * * * *